US010765189B2

(12) United States Patent
Lee

(10) Patent No.: US 10,765,189 B2
(45) Date of Patent: Sep. 8, 2020

(54) SUITCASE

(71) Applicant: Shu-Ming Lee, Taipei, Taiwan (TW)

(72) Inventor: Shu-Ming Lee, Taipei (TW)

( * ) Notice: Subject to any disclaimer, the term of this patent is extended or adjusted under 35 U.S.C. 154(b) by 140 days.

(21) Appl. No.: 16/006,698

(22) Filed: Jun. 12, 2018

(65) Prior Publication Data

US 2019/0373997 A1 Dec. 12, 2019

(51) Int. Cl.
*A45C 13/18* (2006.01)
*A45C 5/03* (2006.01)

(52) U.S. Cl.
CPC ..... *A45C 13/18* (2013.01); *A45C 5/03* (2013.01)

(58) Field of Classification Search
CPC ..... A45C 13/18; A45C 5/03
See application file for complete search history.

(56) References Cited

U.S. PATENT DOCUMENTS 4,081,882 A * 4/1978 Toepelt ..... A44B 19/301 24/386
4,514,915 A * 5/1985 Galetta ..... A43B 5/0415 36/1
4,578,866 A * 4/1986 Bruemmer ..... A43D 1/025 33/3 B
4,790,156 A * 12/1988 Yang ..... A44B 19/301 24/386
6,467,135 B1 * 10/2002 Schuster ..... A44B 19/262 24/381
7,200,901 B2 * 4/2007 Pitts ..... A44B 19/262 24/436
2015/0040622 A1 * 2/2015 Meersschaert ..... E05B 37/12 70/69

* cited by examiner

*Primary Examiner* — Tri M Mai
(74) *Attorney, Agent, or Firm* — Sinorica, LLC

(57) ABSTRACT

A suitcase has a body and two zippers. The body has two openings defined in a surface of the body. The two zippers are mounted respectively in the openings of the body and are defined respectively as a first zipper and a second zipper. The first zipper has two collar pullers. The second zipper has two elongated pullers selectively extending through the collar pullers of the first zipper, and each elongated puller of the second zipper has a locking hole defined in the elongated puller.

3 Claims, 3 Drawing Sheets

SUITCASE

BACKGROUND OF THE INVENTION

1. Field of the Invention

The present invention relates to a suitcase, and more particularly to a suitcase having two zippers applied with and locked by one single lock.

2. Description of Related Art

A suitcase is applied to contain personal belongings of a user on travels. A conventional suitcase substantially comprises a body and a zipper. The body has an opening defined in a top or a side of the body. The zipper is mounted in the opening to close the opening. To prevent the opening from being opened unintentionally by an authorized person, a lock is applied to lock the zipper.

In another type of the conventional suitcase, an interior of the body is divided into multiple spaces to allow arrangement of different kinds of objects in the spaces respectively, Thus, two openings are defined in the body, and two zippers are mounted respectively in the openings. To lock the two zippers, two locks are necessary. Therefore, to lock the conventional suitcase having two zippers is inconvenient and costly.

To overcome the shortcomings, the present invention tends to provide a suitcase to mitigate or obviate the aforementioned problems.

SUMMARY OF THE INVENTION

The main objective of the invention is to provide a suitcase having two zippers applied to and locked by a single lock.

The suitcase has a body and two zippers. The body has two openings defined in a surface of the body. The two zippers are mounted respectively in the openings of the body and are defined respectively as a first zipper and a second zipper. The first zipper has two collar pullers. The second zipper has two elongated pullers selectively extending through the collar pullers of the first zipper, and each elongated puller of the second zipper has a locking hole defined in the elongated puller.

Other objects, advantages and novel features of the invention will become more apparent from the following detailed description when taken in conjunction with the accompanying drawings.

DETAILED DESCRIPTION OF PREFERRED EMBODIMENT

Figure 1:
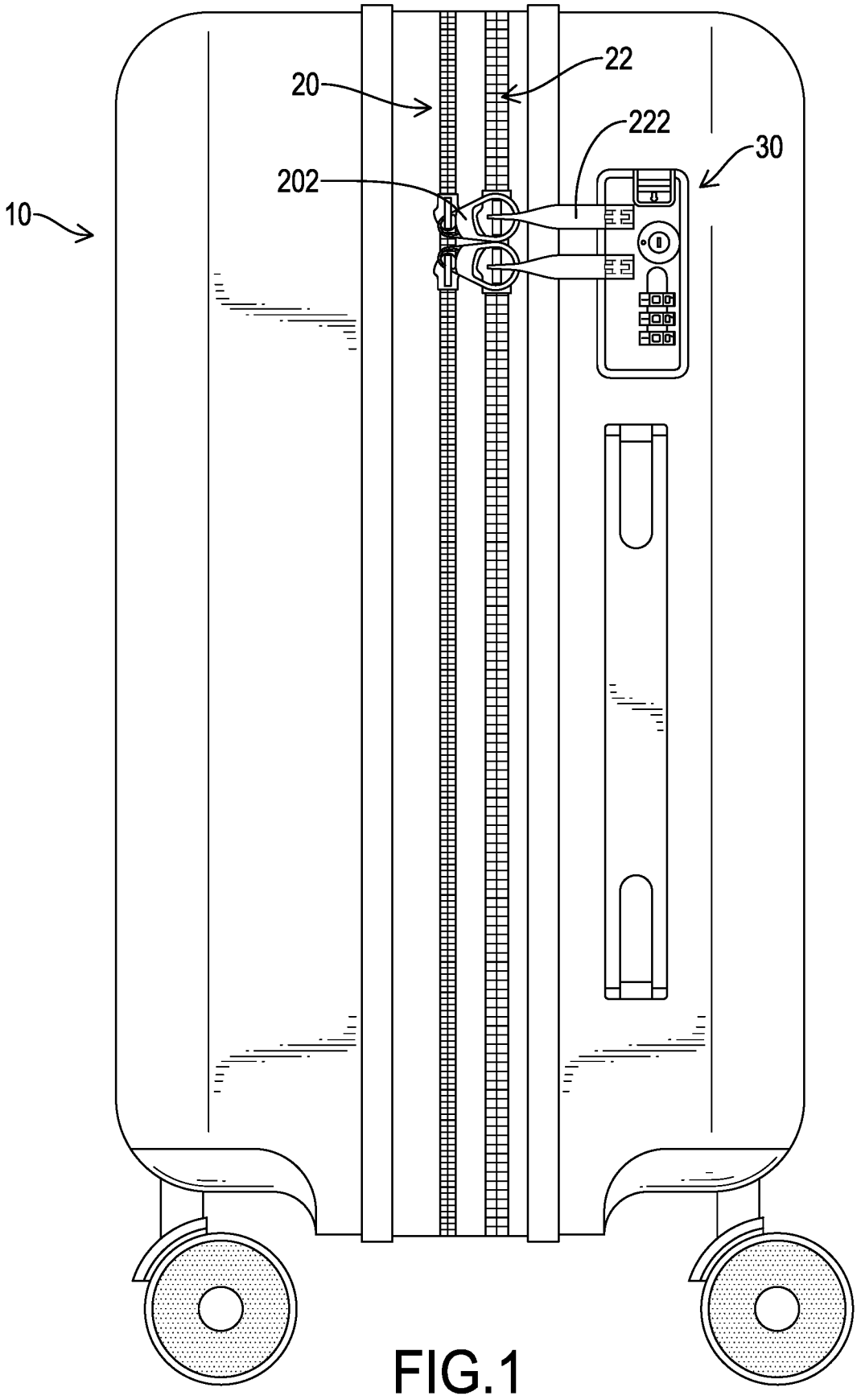
FIG. 1 is a side view of a suitcase in accordance with the present invention.
Figure 2:
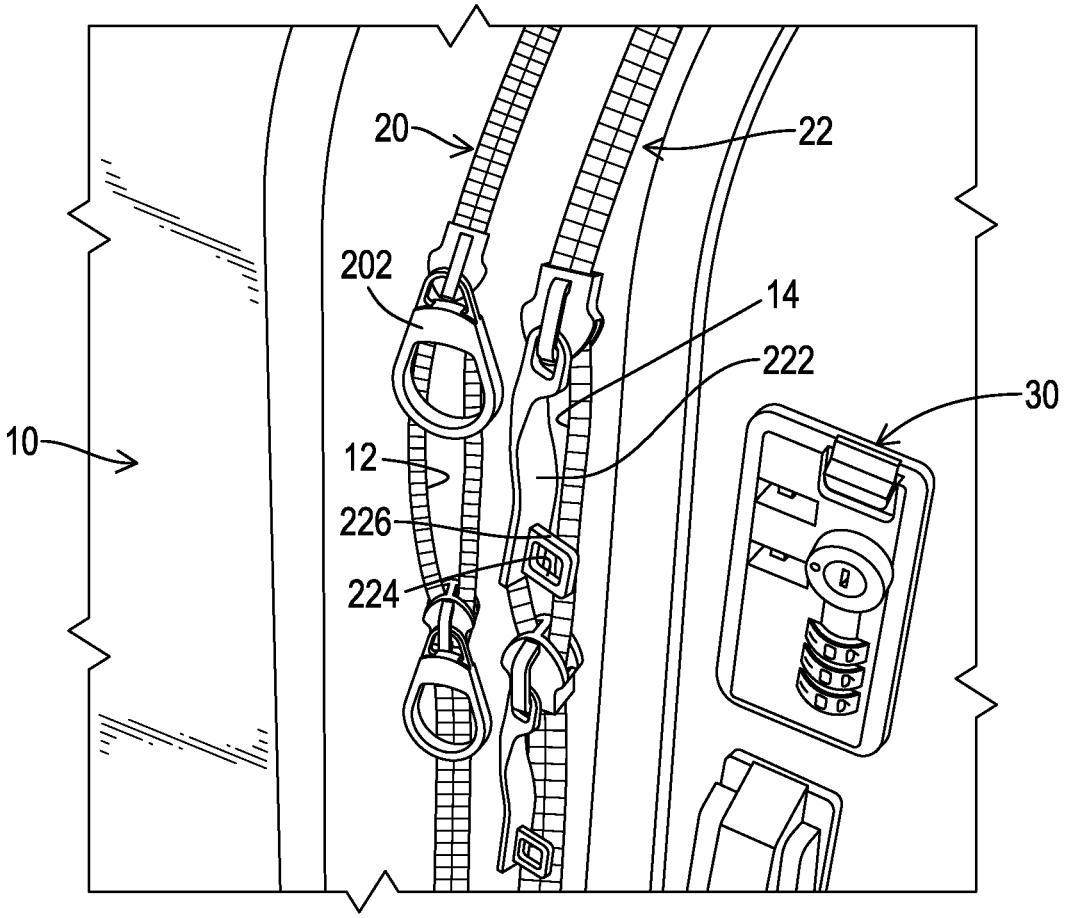
FIG. 2 is an enlarged perspective view of the suitcase in FIG. 1.

With reference to FIGS. 1 and 2, a suitcase in accordance with the present invention may be a luggage or a hand held bag and comprises a body 10 and two zippers 20,22. The body 10 has multiple spaces and two openings 12,14. The spaces are defined and divided in the body 10 to allow a user to put different kinds of objects into the spaces respectively, The two openings 12,14 are defined in a side or a top of the body 10 and communicate with the spaces. The zippers 20,22 are mounted respectively in the openings 12,14 to close the openings 12,14 and defined respectively as a first zipper 20 and a second zipper 22. The first zipper 20 has two collar pullers 202. The second zipper 22 has two elongated pullers 222, and each elongated puller 222 has a locking hole 224 defined in the elongated puller 222. Preferably, each elongated puller 222 has a locking tab 226 formed on and protruding from a free end of the elongated puller 222, and the locking hole 224 is defined in the locking tab 226. In addition, a lock 30 is mounted on the body 10 at a surface in which the openings 12,14 are defined and is adjacent to the second zipper 22.

To lock the zippers 20,22, the elongated pullers 222 of the second zipper 22 extend respectively through the collar pullers 202 of the first zipper 20 and are locked by the lock 30 with the locking holes 224. In the present embodiment, the locking tabs 226 on the elongated pullers 222 are inserted into two locking slots in the lock 30, and the locking holes 224 in the locking tabs 226 are engaged with locking pins in the lock 30.

With such an arrangement, only one single lock 30 is necessary for locking the two zippers 20,22 to prevent the body 10 from being opened unintentionally by an unauthorized person, so there is no need to adopt two locks. Therefore, to lock the two zippers 20,22 is convenient and takes a lowered cost.

Figure 3:
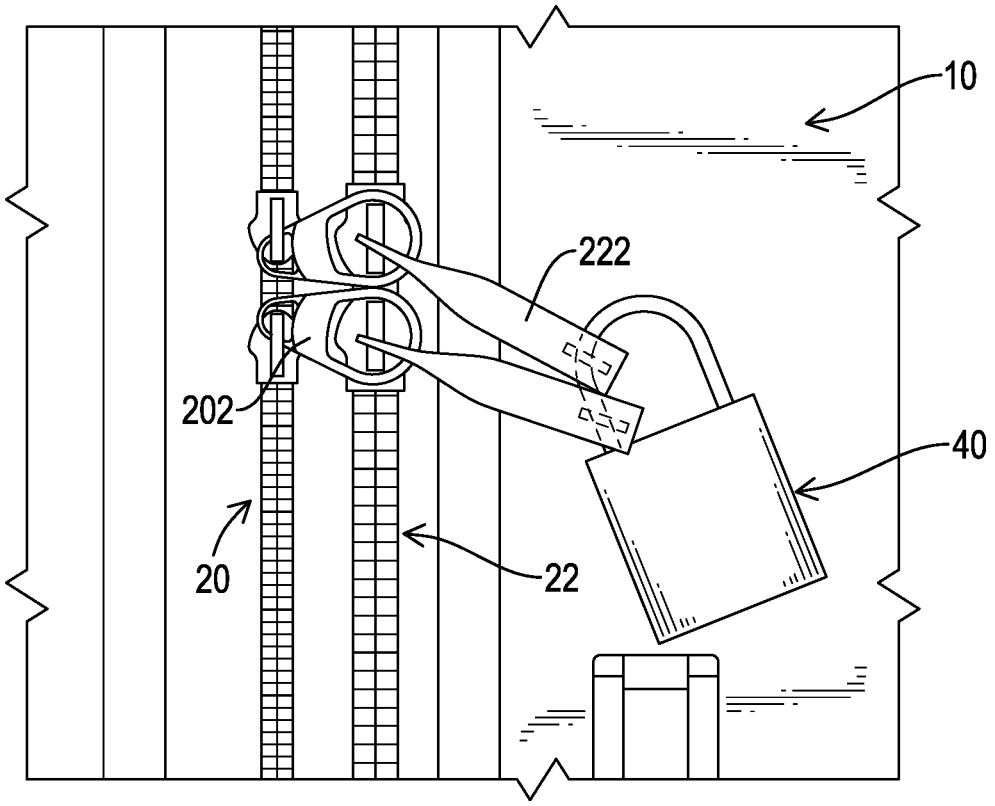
FIG. 3 is an enlarged side view of another embodiment of a suitcase in accordance with the present invention.

With reference to FIG. 3, in another embodiment, a lock 30 is free from being mounted on the body 10, and the zippers 20,22 can be locked by an individual lock 40, such as a code lock or a key lock. Accordingly, the structure of the suitcase can be simplified.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A suitcase comprising:

a body having two openings defined in a surface of the body; and two zippers mounted respectively in the openings of the body and defined respectively as a first zipper and a second zipper, wherein the first zipper has two collar pullers, and each collar puller has a shape and a circular through hole defined through the collar puller; and the second zipper has two elongated pullers having a shape different from that of the collar pullers and selectively extending through the circular through holes of the collar pullers of the first zipper, and each elongated puller of the second zipper has a locking hole defined in the elongated puller.

2. The suitcase as claimed in claim 1, wherein the body further has a lock mounted on the body at the surface in which the two openings are defined.

3. The suitcase as claimed in claim 2, wherein each elongated puller of the second zipper comprises a locking tab formed on a free end of the elongated puller; and the locking hole in each of the elongated pullers of the second zipper is defined in the locking tab.

* * * * *